US007267145B2

(12) United States Patent
Nyhof et al.

(10) Patent No.: US 7,267,145 B2
(45) Date of Patent: Sep. 11, 2007

(54) BULK BAG FILLING SYSTEM

(75) Inventors: Scott L. Nyhof, Hamilton, MI (US); Jesse L. Smith, Allegan, MI (US)

(73) Assignee: Material Transfer & Storage, Inc., Allegan, MI (US)

( * ) Notice: Subject to any disclaimer, the term of this patent is extended or adjusted under 35 U.S.C. 154(b) by 0 days.

(21) Appl. No.: 11/415,779

(22) Filed: May 2, 2006

(65) Prior Publication Data

US 2006/0196578 A1 Sep. 7, 2006

Related U.S. Application Data

(63) Continuation-in-part of application No. 11/119,872, filed on May 2, 2005.

(60) Provisional application No. 60/567,709, filed on May 3, 2004.

(51) Int. Cl.
*B65B 1/04* (2006.01)

(52) U.S. Cl. ..... 141/314; 141/114

(58) Field of Classification Search ..... 141/10, 141/114, 313–316; 53/468–473
See application file for complete search history.

(56) References Cited

U.S. PATENT DOCUMENTS

| | | | |
|---|---|---|---|
| 5,036,893 | A | 8/1991 | DeCrane |
| 5,056,571 | A | 10/1991 | Derby |
| 5,320,251 | A | 6/1994 | Ellis |
| 5,348,063 | A | 9/1994 | Handleman |
| 5,354,166 | A | 10/1994 | DeCrane |
| 5,400,837 | A | 3/1995 | Kelley et al. |
| 5,494,189 | A | 2/1996 | DeCrane |
| 5,787,945 | A | 8/1998 | Riemersma |
| 5,788,449 | A | 8/1998 | Riemersma |
| 6,089,283 | A | 7/2000 | Sienerth et al. |
| 6,149,110 | A | 11/2000 | Gill et al. |
| 6,340,100 | B1 | 1/2002 | Gill et al. |
| 6,427,955 | B1 | 8/2002 | Sterner et al. |
| 6,564,534 | B2 | 5/2003 | Poulton et al. |
| 6,776,197 | B1 | 8/2004 | DeCrane |
| 7,004,212 | B2 * | 2/2006 | Gill et al. ..... 141/316 |

OTHER PUBLICATIONS

Flexicon Catalog, "More of what you want from a bulk food conveyor: Less of what you don't," 2005 (1 page).
Flexicon Catalog, "Bulk bag filling just got faster, safer and easier," 2004 (1 page).
Tech Pak, www.tech-pak.com/5000.htm, "Series 5000 Bulk Bag Filling Systems," Jul. 9, 2004 (3 pages).
Tech Pak. www.tech-pak.com/PAKRAT.html, "Pakrat Series 4400H/P Bag Filling Systems," Jul. 9, 2004 (3 pages).
Tech Pak, www.tech-pak.com/330e.html, "Quickpak Series 330E Bulk Bag Filling System," Jul. 9 2004 (3 pages).
National Bulk Equipment, Inc., "Hang-weigh bulk bag fillers," 1999 (3 pages).

* cited by examiner

*Primary Examiner*—Steven O. Douglas
(74) *Attorney, Agent, or Firm*—Price, Heneveld, Cooper, DeWitt & Litton

(57) ABSTRACT

A bulk bag filling system has a horizontal displacement device pivotally connected to a fill carriage. The fill carriage is rotated outwardly about a pivot axis existing at the interface between the horizontal displacement device and the fill carriage. Bag loops of a bulk bag are captured with bag loop hangers.

22 Claims, 15 Drawing Sheets

BULK BAG FILLING SYSTEM

This application is a continuation-in-part of application Ser. No. 11/119,872, entitled, "BULK BAG FILLING SYSTEM," by Scott L. Nyhof et al. filed May 2, 2005, the entire disclosure of which is hereby incorporated by reference in its entirety, which claims the benefit of U.S. Provisional patent application Ser. No. 60/567,709 entitled, "BULK BAG FILLING SYSTEM," by Scott L. Nyhof et al., filed May 3, 2004, the entire disclosure of which is hereby incorporated by reference in its entirety.

BACKGROUND OF THE INVENTION

The present invention is generally directed to a filling system and, more specifically, to a bulk bag filling system. The present invention may also be utilized to fill various sizes of containers, boxes, drums, small bags, kegs, barrels, etc., although it is contemplated that this system is primarily used as a bulk bag filler.

A wide variety of filling systems have been utilized for bulk material handling. In general, systems that have been utilized to fill a bag with a bulk material have included stationary bag loop hangers that received bag loops of a bag to be filled. While many of these prior art bulk bag filling systems are satisfactory for low-volume filling, these systems are generally not suitable for high-volume production filling.

A common problem with bulk bag filling systems is the need for an operator to reach into the machine to access bag loop connection points and a bag spout connection point. Various manufacturers have attempted to address this issue by moving the rear most bag loop connection points forward, toward the operator. While this technique provides some relief, the technique fails to fully address the ergonomic issue of requiring an operator to reach into the machine to connect a bag, as the front and rear connection points still remain substantially over a base of the system. Another issue with prior art bulk bag filling systems is the bag spout connection point, which has been located considerably farther in over the base than the front bag loop connections points, has been fixed and, thus, has not been readily accessible to an operator.

Still other manufacturers have developed bulk bag filling systems with an assembly, which included bag loop connection points and a bag spout connection point that has moved downward and forward to facilitate bag attachment. While this moves the bag loop connection points toward the operator, the fill spout is horizontal to the floor in the bag loading position. Thus, an operator must reach down, below hip level, and connect the lower bag loops while simultaneously supporting and properly orientating the bag. In this configuration, the operator is placed into an undesirable position while making these connections as the bag prevents the operator from properly bending at the knees. Furthermore, to load a bag, the operator is forced to bend with his/her back, while reaching a relatively long distance. Once the bottom bag loops are connected, the operator is still faced with the difficult task of connecting the bag spout onto the connection point.

Additionally, some systems have been provided which include bag loop connection points and a bag spout connection point that can be moved forward on a track located above the bulk bag. These systems are limited in that they can usually move the bulk bag relatively short distances—usually no more than 12 inches. Also, because these track and carriage systems use tracks, they must be maintained regularly with appropriate lubricants and are difficult to clean. If cleaning of the area is required, care must be taken not to wash away lubricants and to make sure the lubricants do not infiltrate the bulk bag. Additionally, these systems frequently have large carriage head mechanisms utilizing cams and tracks that are inherently unclean due to the grease and other lubrication required, which is undesirable.

In the past, in order to connect the spout, the operator has been required to get around a number of hurdles, i.e., the operator must hold the bulk bag with one hand, while simultaneously positioning the inlet spout of the bag over a horizontal fill spout. When the operator manages to slide the bag spout onto the connection point the operator must then maintain the position of the bag with one hand while reaching for the spout inflation switch. The operator must also reach up, above shoulder level, to connect the upper bag loops. All of the tasks listed above must be done while attempting to support and orientate a bag that, based on the general laws of physics and gravity, is difficult to position to make the required connection.

Accordingly, an ergonomically designed bulk bag filling system that is capable of operating in a high-volume production environment and that provides easy access to the bag loop connection points and a bag spout connection point by the operator would be useful and an improvement in the art.

SUMMARY OF THE INVENTION

In one embodiment of the present invention, a bulk bag filling system includes a frame having a base and a fill carriage coupled to the frame, wherein the fill carriage is typically substantially alignable, more typically completely alignable, with a fill port for receiving a bulk material. A rotary carriage has bag loop hangers for receiving bag loops of a bag to be filled, wherein the rotary carriage is movably coupled to the fill carriage. A spout for receiving a neck of the bag to be filled extends through the rotary carriage. The rotary carriage may be horizontally and vertically adjusted.

According to another aspect of the present invention, a horizontal displacement device is engaged or coupled to a support member on a first end and pivotally engaged to a fill carriage on a second end. The fill carriage is typically capable of being rotated between a bag filling position and an extended position.

According to yet another aspect of the present invention, a bulk bag filling system is provided that includes a base, an upwardly extending support member, and a horizontal displacement device pivotally connected to a fill carriage. The fill carriage may be rotated outwardly about a pivot axis existing at one end of the horizontal displacement device. Bag loops of a bulk bag are typically captured with bag loop hangers. The bulk bag may be vertically elevated with the bag loop hangers. The bulk bag may be horizontally relocated into a filling position below a spout. The bulk bag may be filled with material and the bag loops of the bulk bag are released from the bag loop hangers.

These and other features, advantages and objects of the present invention will be further understood and appreciated by those skilled in the art by reference to the following specification, claims, and appended drawings.

DETAILED DESCRIPTION OF PREFERRED EMBODIMENTS

According to the present invention, a bulk bag filling system that exhibits user friendly ergonomic operation, while generally reducing the time required for a bag fill operation, is disclosed herein. According to various aspects of the present invention, the bulk bag filling system can be configured to include a fill head and a rotary head, including a plurality of bag loop hangers that extend toward the operator for effortless bag hanging. The bulk bag filling system may also be configured with a bag inflation subsystem that ensures the bag is properly filled for improved handling and storage. Additionally, the bulk bag filling system may also include a dust-tight spout system that assures a positive seal for safe dust-free filling of various powders, e.g., submicron powders. According to another aspect of the present invention, the bulk bag filling system includes a densification system that provides a stable compact stackable bag. According to yet another aspect of the present invention, the bulk bag filling system includes a scale that ensures accurate repeatable filling of bulk bags.

It should be appreciated that many of the independent features that may be incorporated in a bulk bag filling system, designed according to the present invention, are optional. For example, there are different types of hooks (or hangers) available for receiving bag loops. Depending upon how a purchaser wishes to configure their bulk bag filling system, automatically actuated hooks or manual hooks may be employed. When hooks are automatically actuated, the hooks may or may not have a "loading" position. The hanger subsystem may be rotational or stationary. Rotational hanger subsystems may be automatically or manually rotated. The fill head may or may not move in and out. If the system includes a horizontally movable fill head, the fill head may be automatically or manually actuated. In systems that do not include a moveable fill head, an inflatable seal is typically not required between the fill head and the inlet tube. The fill head may or may not move up and down. If the system includes a vertically moveable fill head, the fill head may be automatically or manually actuated.

The controls of the bulk bag filling system may or may not be "processor based." That is, the system may use standard industrial controls and relay logic. The inflatable spout seal is optional and in systems that do not employ an inflatable seal, there are several other methods of attaching/sealing the spout to the fill head. In systems that do include a densifier, an isolation system is not required. The scale system is optional—if there is a scale system, it may or may not be used to control the filling cycle. That is, the scale system may only provide the operator with a numeric readout so that the operator knows how much material is contained within the bag.

Figure 1:
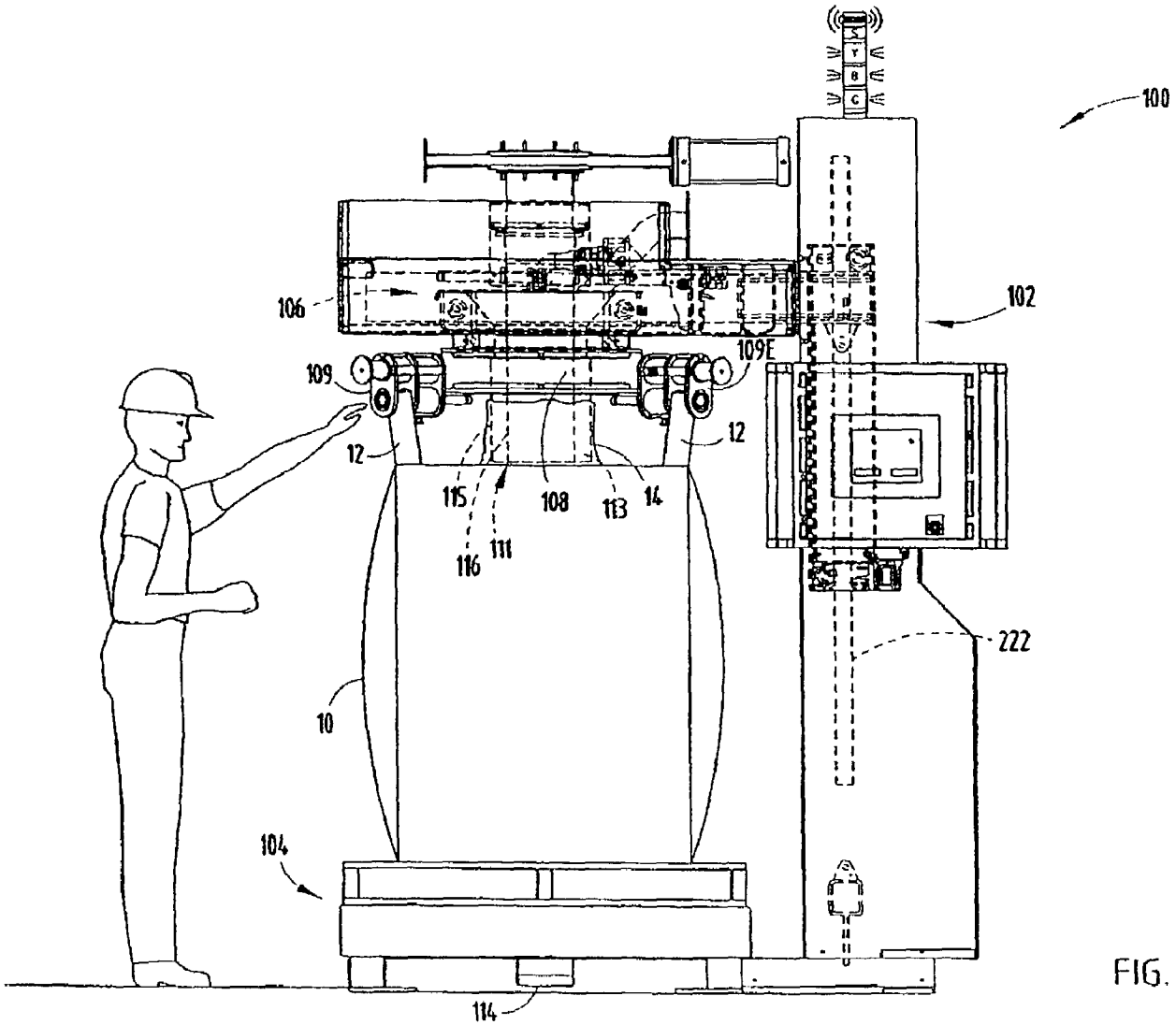
FIG. 1 is a side view of a relevant portion of a bulk bag filling system, constructed according to one embodiment of the present invention.

With reference to FIG. 1, a bulk bag filling system 100 includes frame 102 that has a base 104 extending therefrom. As is shown in FIG. 1, a bulk bag 10 includes a plurality of bag loops 12, each of which have been received by a bag loop hanger 109 of a rotary carriage 108. As is shown, a neck 14 of the bag 10 is received on a spout 111 that extends below the rotary carriage 108. A seal 113, which is typically an inflatable seal of a spout seal inflation subsystem, seals the neck 14 of the bag 10 to the spout 111. As shown in various Figures, including FIG. 1, the spout 111 typically includes a center pipe 116 and an outer pipe 115.

A vibrator 114, e.g., a non-impacting linear vibrator, may be located within the base 104 and may be periodically activated, responsive to readings provided by a scale, to ensure that the bulk material received in the bag 10 fills the bag 10 in a uniform manner. The readings provided by the scale may also be used by a control unit to automatically release a bag.

Figure 1A:
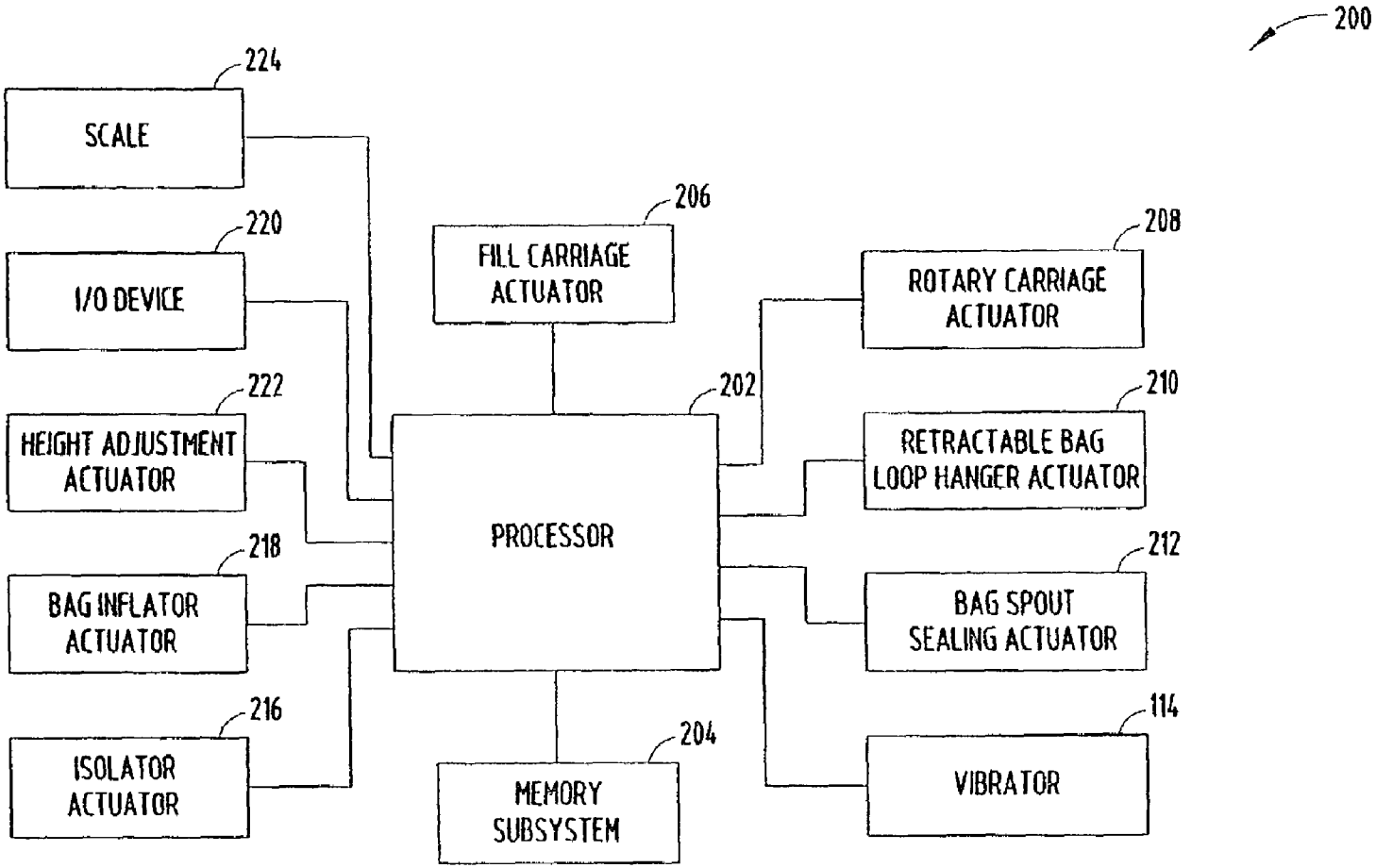
FIG. 1A is an exemplary electrical block diagram of an electrical subsystem for the bulk bag filling system of FIG. 1.

With reference to FIG. 1A, an exemplary electrical block diagram of an electrical subsystem 200 for the bulk bag filling system 100 is shown. The subsystem 200 includes a processor 202 that is coupled to a memory subsystem 204. The processor 202 may take various forms, such as a programmable logic device (PLD), and the memory subsystem 204 includes an application appropriate amount of volatile and non-volatile memory. The processor 202 may also be coupled to an isolator actuator (e.g., a pneumatic actuator) 216, which, when implemented, allows the processor 202 to isolate the frame 102 from the vibration provided by a vibrator 114. The processor 202 is coupled to the vibrator 114 and periodically, e.g., responsive to a reading provided by scale 224, controls activation of the vibrator 114 to ensure that the bulk bag 10 is properly loaded. The processor 202 is also coupled to the scale 224, which provides a signal indicative of the weight of the bag 10, such that the processor 202 can determine the weight of the bag 10 and initiate a desired task, such as discontinue filling of the bag 10 when the bag 10 has reached a desired weight. The processor 202 is also coupled to and controls a height adjustment actuator (e.g., an electric actuator) 222, which is coupled to the frame 102, to position a fill carriage 106 at an appropriate height. For example, when the fill carriage 106 is positioned in a bag loading position, the processor 202 controls the height adjustment actuator 222 to adjust the height of the fill carriage 106 to an operator selectable height.

After the bag 10 is full, as indicated by the scale 224, the processor 202 controls a retractable bag loop hanger actuator (e.g., a pneumatic actuator) 210 to release the loops 12 of the bag 10 and adjust the height of the fill carriage 106 by sending an appropriate signal to the height adjustment actuator 222, such that the bag 10 can be readily unloaded. The processor 202 is in communication with an I/O device 220, which allows an operator of the system 100 to select appropriate operating conditions and to receive various information, e.g., the weight of a bag. The processor 202 is also typically coupled to a bag spout sealing actuator 212, which allows the processor 202 to seal the neck 14 of the bag 10 to the spout 111. The processor 202 is also coupled to a fill carriage actuator (e.g., an electric actuator) 206 and may be coupled to a rotary carriage actuator 208 (when implemented). The processor 202 controls the fill carriage actuator 206, typically between one of two positions, i.e., a bag loading position and a bag filling position.

Figure 2B:
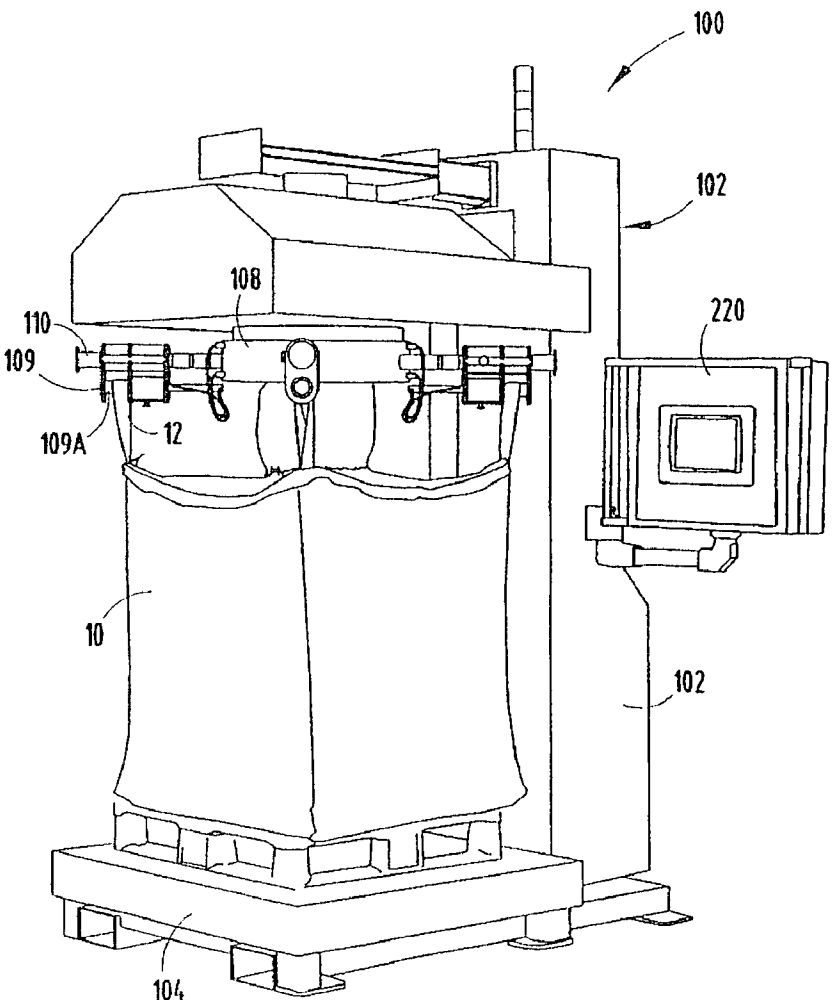
FIG. 2B is a perspective view of the bulk bag filling system of FIG. 2A, including an inflated bag attached to the rotary carriage and the spout of the system.

When the rotary carriage actuator 208 is implemented, the processor 202 may control rotation of the plurality of bag loop hangers 109 to allow an operator to readily insert the bag loops 12 over the bag loop capture pins 109A of the bag loop hangers 109. Alternatively, when the rotary carriage actuator 208 is not implemented, the rotary carriage 108 may be rotated in a manual manner by the operator. As is briefly mentioned above, the processor 202 is coupled to a retractable bag loop hanger actuator (typically a pneumatic actuator) 210 and controls the position of the bag loop capture pin 109A. It should be appreciated that when the bag loops 12 are being received by and placed on the bag loop capture pins 109A, the bag loop capture pins 109A are positioned in a bag loop receiving position. When in the bag loop receiving position, a bag loop 12 can be placed into position on a portion of the bag loop capture pin 109A (see FIG. 2H), the portion that remains exposed. Thereafter, the operator can simply release the bag loop capture pin 109A by pulling retaining pin 109B downward to release the capture pin 109A into a bag loop engaged position (see FIG. 2F). Typically, the capture pin 109A is actuated to the engaged/bag retention position, when the retaining pin 109B is pulled downward, via a spring or other force application mechanism, which is typically contained within the pneumatic cylinder. Prior to capture pin 109A being actuated to the receiving position and when the bag loop is being released, the capture pin 109A moves into the retracted position (FIG. 2G). Typically, this is accomplished using the pneumatic actuator 210 to retract the capture pin 109A and thereby release the bag loop. Thereafter, the capture pin 109A is moved into the bag loop receiving position (FIG. 2H). When in the retracted position, the capture pin 109A is withdrawn from the bag loop receiving space 109D of the bag loop hanger 109, which is defined by two of the three support members 109E of the bag hangers. The center support members each have two apertures, one for receiving the outwardly, radially extending support members 110 and one that facilitates the implementation of the bag loop capture pin 109A. In the bag loop receiving position, a portion of bag loop capture pin 109A is exposed to allow the operator to readily hang the bag loop on the capture pin.

Finally, the bag loop hangers 109 may optionally be moveable between positions radially along extending support members 110, which typically are spaced at 90 degree intervals from one another and extend outwardly from the center portion of the rotary carriage, by releasing pin 109C. The rotary carriage is typically spaced circumferentially about at least a portion of the fill carriage. This configuration allows optimal support for the bag loop, which are located at the corners of the typically square topped bag. The movement of the bag loop hangers 109 facilitates accommodation of bulk bags 10 of various sizes.

Figure 1C:
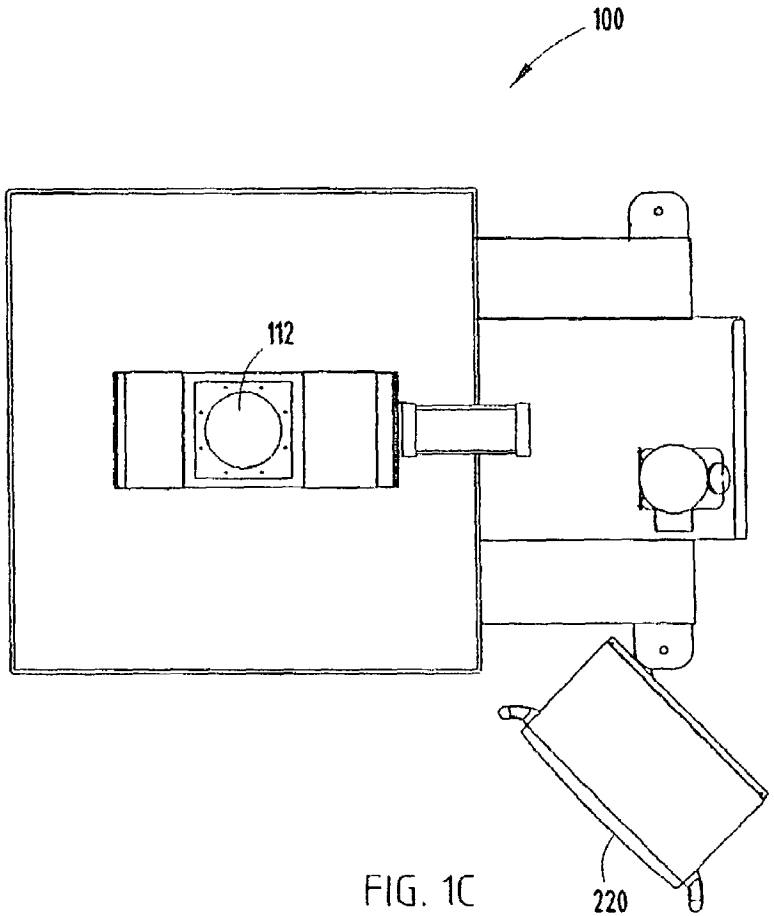
FIG. 1C is a top view of the bulk bag filling system of FIG. 1.
Figure 1B:
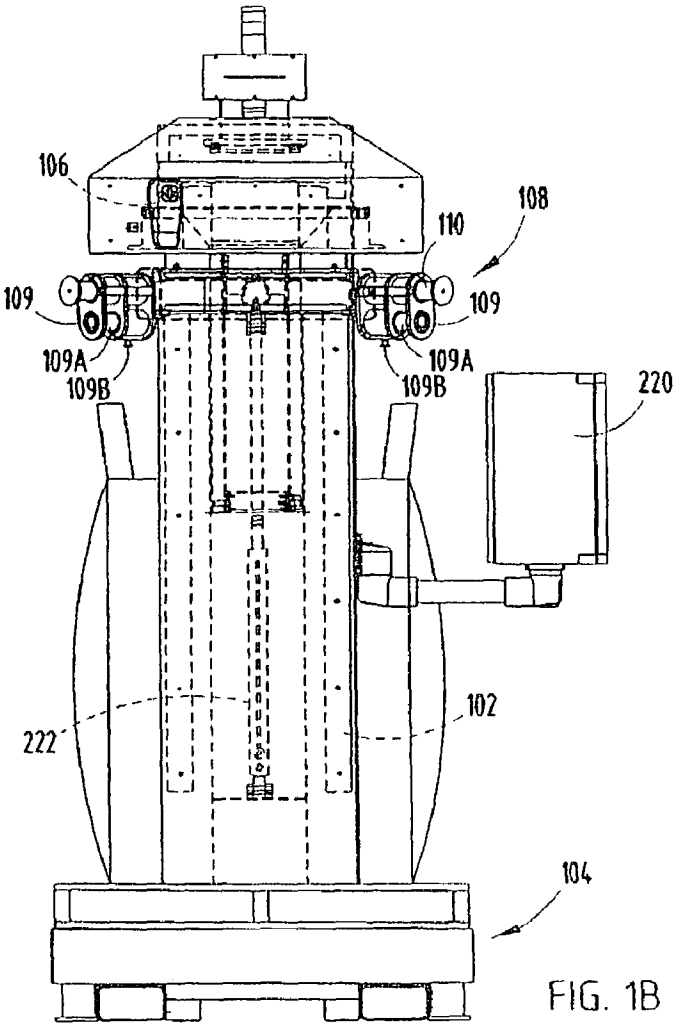
FIG. 1B is a front view of the bulk bag filling system of FIG. 1.

With reference to FIG. 1B, the location of the height adjustment actuator 222 is shown as contained within the frame and extending toward the base 104. As is discussed in detail above, the height adjustment actuator 222 is used to adjust the height of the fill carriage 106 to an operator selectable height when the fill carriage 106 is positioned in the bag loading position (see FIG. 3A). The height adjustment actuator 222 is also utilized to adjust the height of the fill carriage 106 to a bag filling position height, when the fill carriage 106 is positioned in the bag filling position (see FIG. 3B). Additionally, the height adjustment actuator 222 is used to adjust the height of the fill carriage 106 to a bag unloading position height, when the scale 224 indicates that the bag 10 has reached a desired weight (see FIG. 3C). As is also discussed above, the rotary carriage 108 includes a plurality of bag loop hangers 109 extending therefrom. FIG. 1C shows a top schematic view of the bulk bag filling system 100.

Figure 2A:
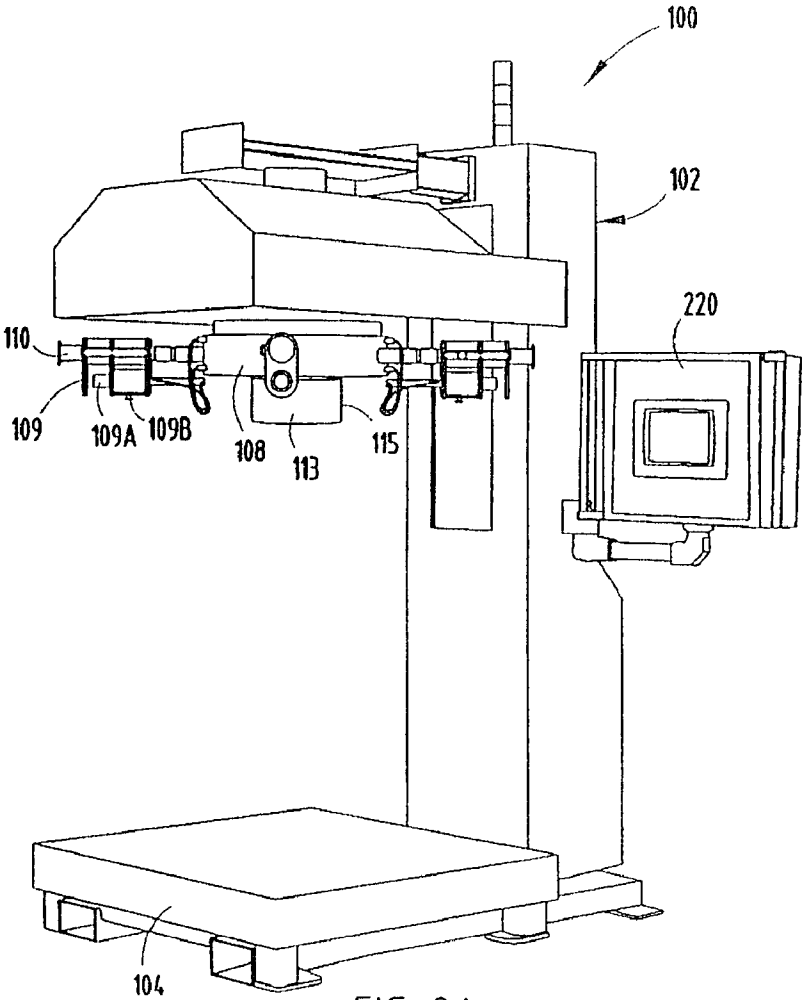
FIG. 2A is a perspective view of a bulk bag filling system constructed according to one embodiment of the present invention, without a bag attached to the spout, which extends from the rotary carriage.

With reference to FIG. 2A, a perspective view of the bulk bag filling system 100 is depicted. As is shown in FIG. 2A, each of the bag loop hangers 109 includes a bag loop capture pin 109A, which is controlled to capture or release a bag loop 12 of the bag 10 (not shown in FIG. 2A). An inflatable seal 113 is shown located on the spout 111, which extends below the rotary carriage 108. When the neck 14 of the bag 10 is positioned on the spout 111, the bag spout sealing actuator 212 is activated to seal the neck 14 of the bag 10 and the spout 111.

Figure 2D:
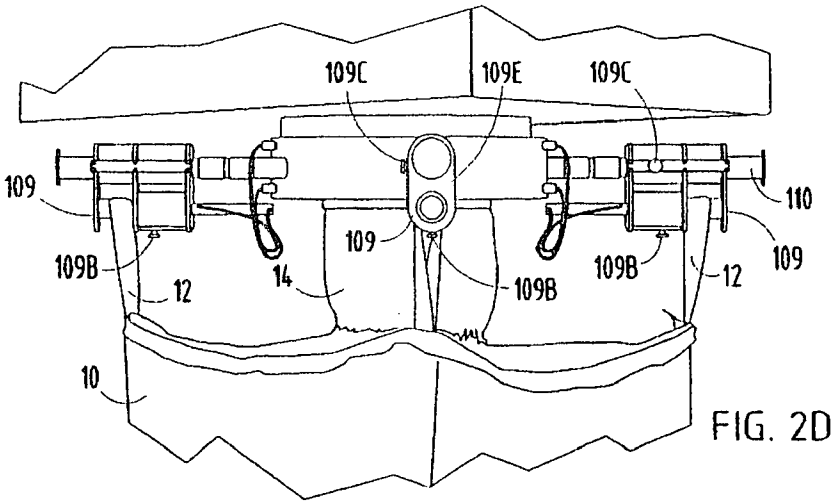
FIG. 2D is an enlarged perspective view of the rotary carriage of the bulk bag filling system of FIG. 2A.
Figure 2E:
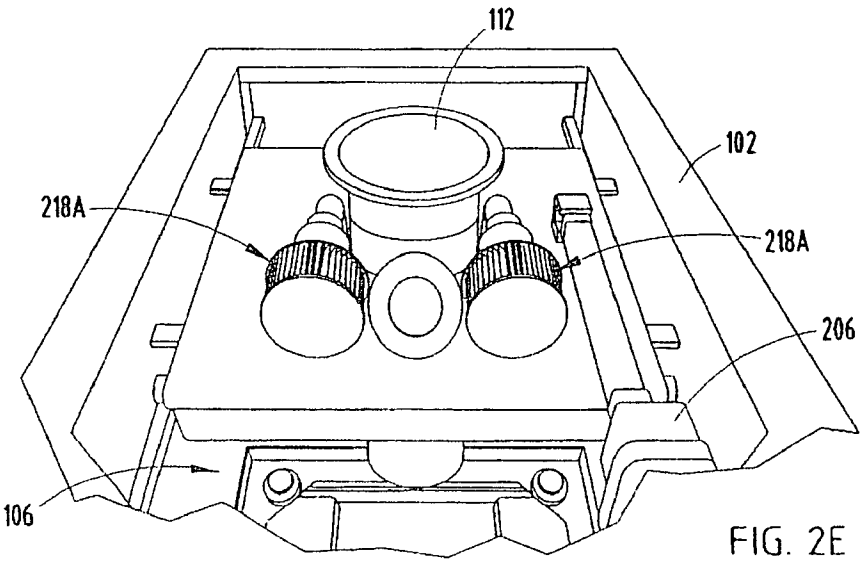
FIG. 2E is an enlarged top perspective view of a fill carriage movably coupled to a frame of the bulk bag filling system of FIG. 2A.
Figure 2C:
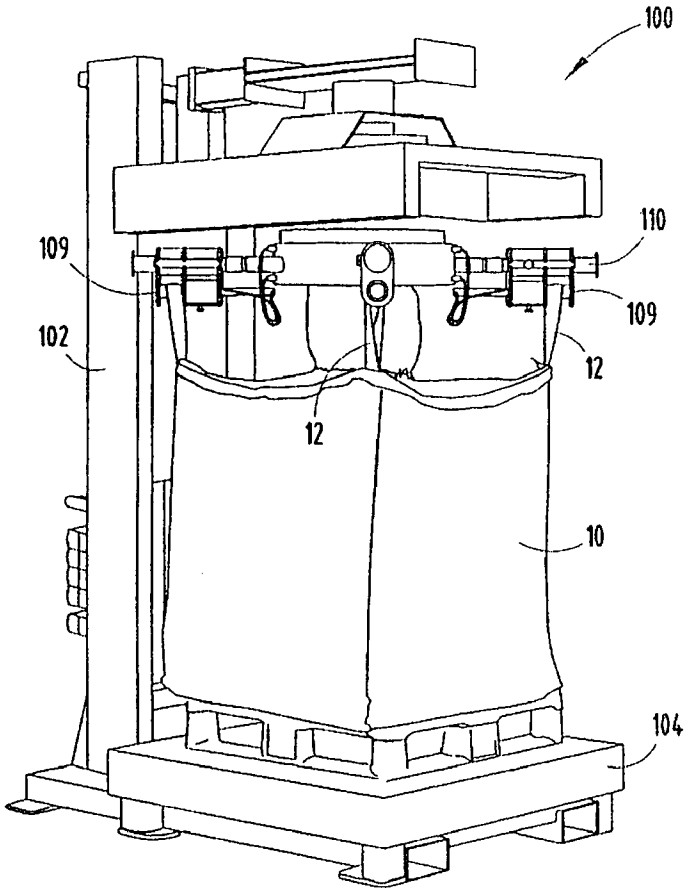
FIG. 2C is another perspective view of a bulk bag filling system, with a bulk bag connected to a rotary head of the bulk bag filling system, with various safety covers removed.
Figure 2F:
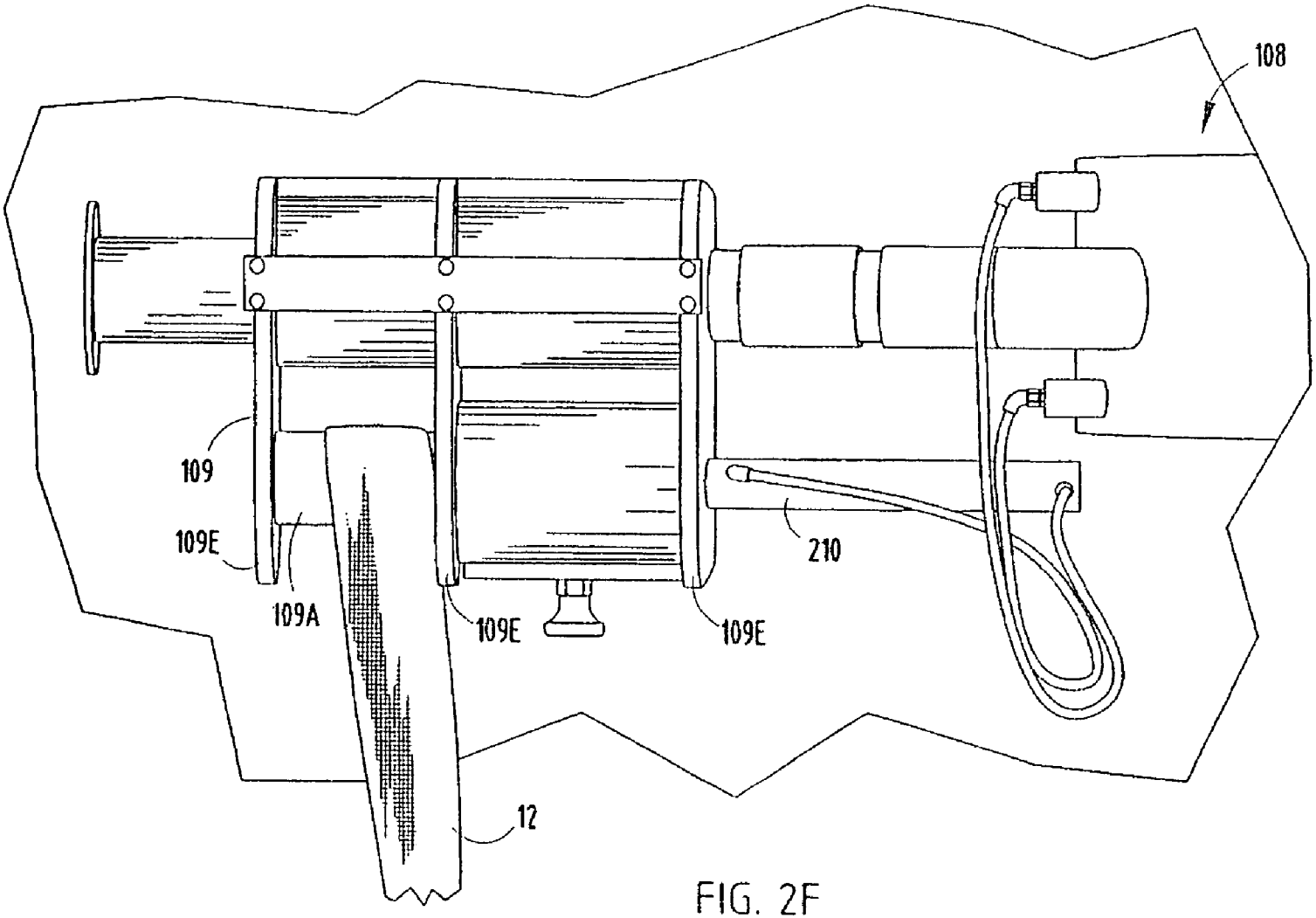
FIG. 2F is an enlarged perspective view of one of the bag loop hangers of the rotary carriage of the bulk bag filling system, with a bag loop of a bag to be filled retained by a bag loop capture pin.
Figure 2G:
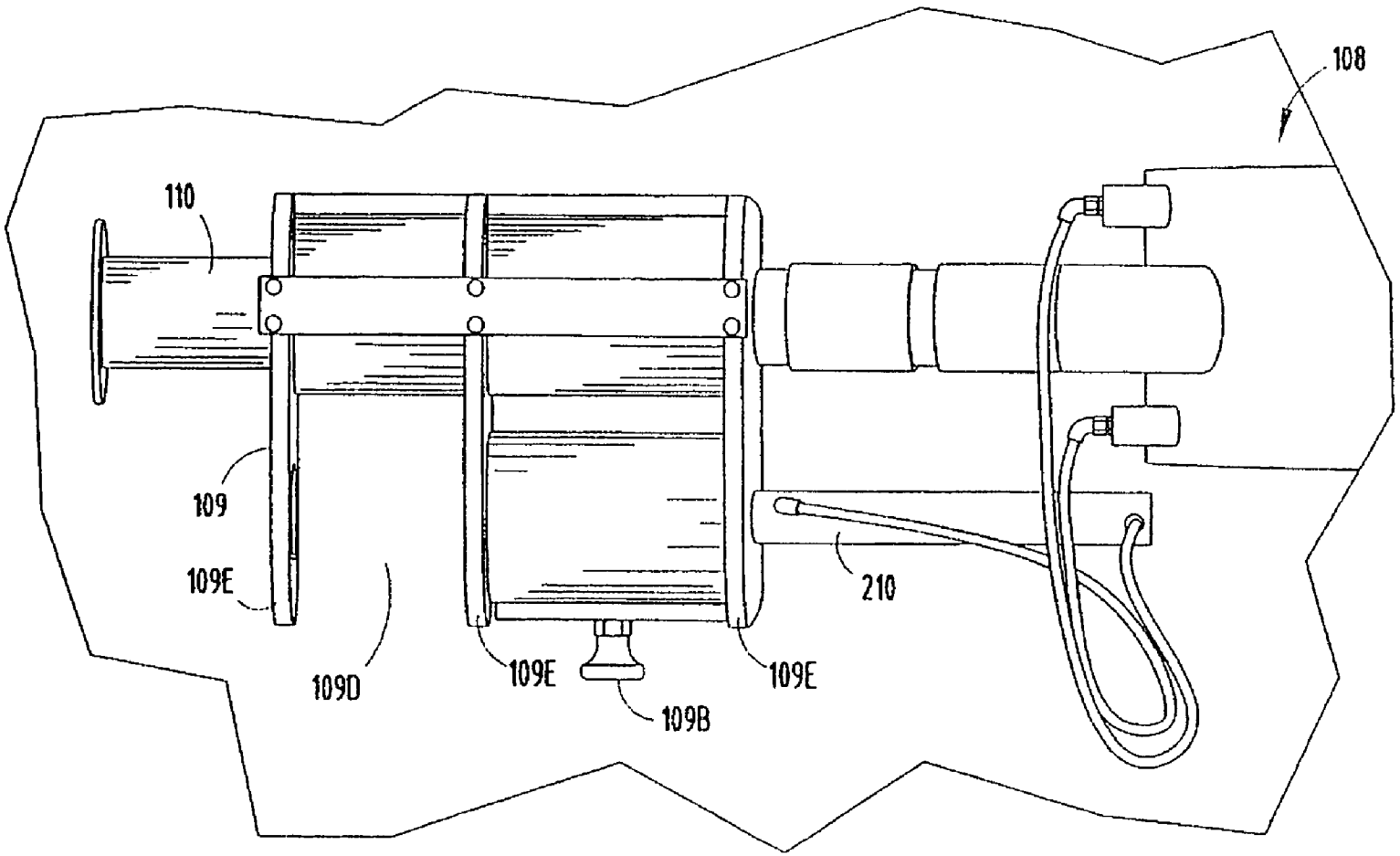
FIG. 2G is an enlarged perspective view of the bag loop hangers of the rotary carriage of the bulk bag filing system with the bag loop capture pin in the retracted position.
Figure 2H:
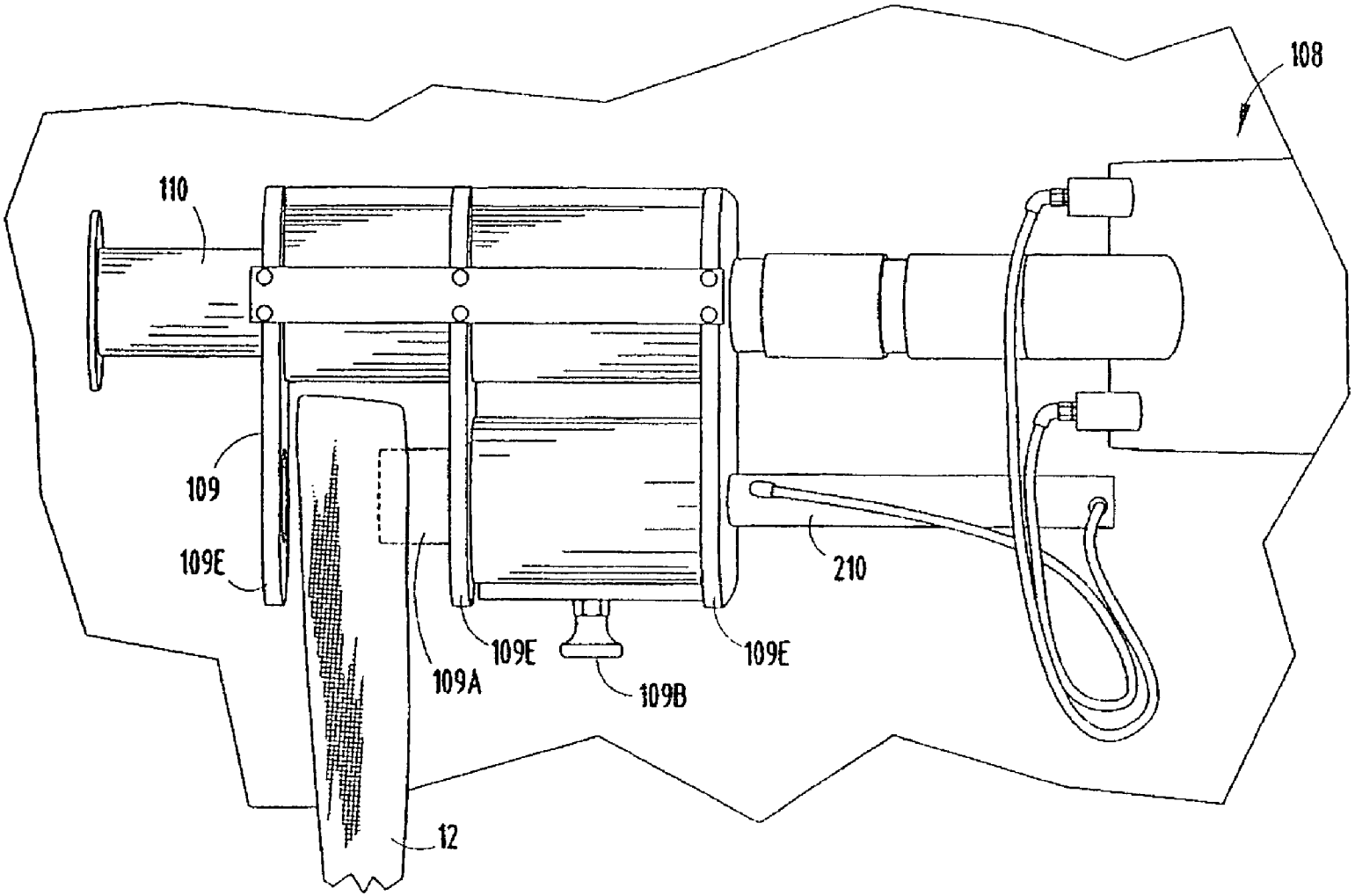
FIG. 2H is an enlarged perspective view of one of the bag loop hangers of the rotary carriage of the bulk bag filling system with the bag loop capture pin in the bag loop receiving position.

With reference to FIG. 2B, a bag 10 (and a pallet) is shown positioned on the base 104 in a bag fill position. The bag loops 12 of the bag 10 are captured by the pins 109A, thus, attaching the bag loops 12 to the bag loop hangers 109. Referring to FIG. 2C, an embodiment of the bulk bag filling system 100 is depicted with a number of safety covers removed. Similar to the view of FIG. 2B, the view of FIG. 2C shows the bulk bag filling system 100 in a bag filling position with a bag 10 attached to the spout 111. FIG. 2D depicts a close-up view of the rotary carriage 108 and depicts the neck 14 of the bag 10 positioned on and sealed to the spout 111, which extends through and below the rotary carriage 108. With reference to FIG. 2E, a top view of a relevant portion of the fill carriage 106 is depicted. The fill carriage 106 is controlled by a fill carriage actuator 206 and includes a fill port 112, for receiving bulk materials, and one or more filter 218A to be used in conjunction with the bag inflator actuator 218. In essence, the bag inflator actuator 218 forces air into the bag to minimize wrinkles and to provide for maximum volume when the bag is being filled with material. As discussed above, when implemented, the bag inflator actuator 218 (FIG. 2E) may implement one or more filters 218A, which facilitates removal of particulates from the air. Turning to FIG. 2F, a bag loop 12 is shown captured by a pin 109A of a bag loop hanger 109 of the rotary carriage 108.

Figure 2I:
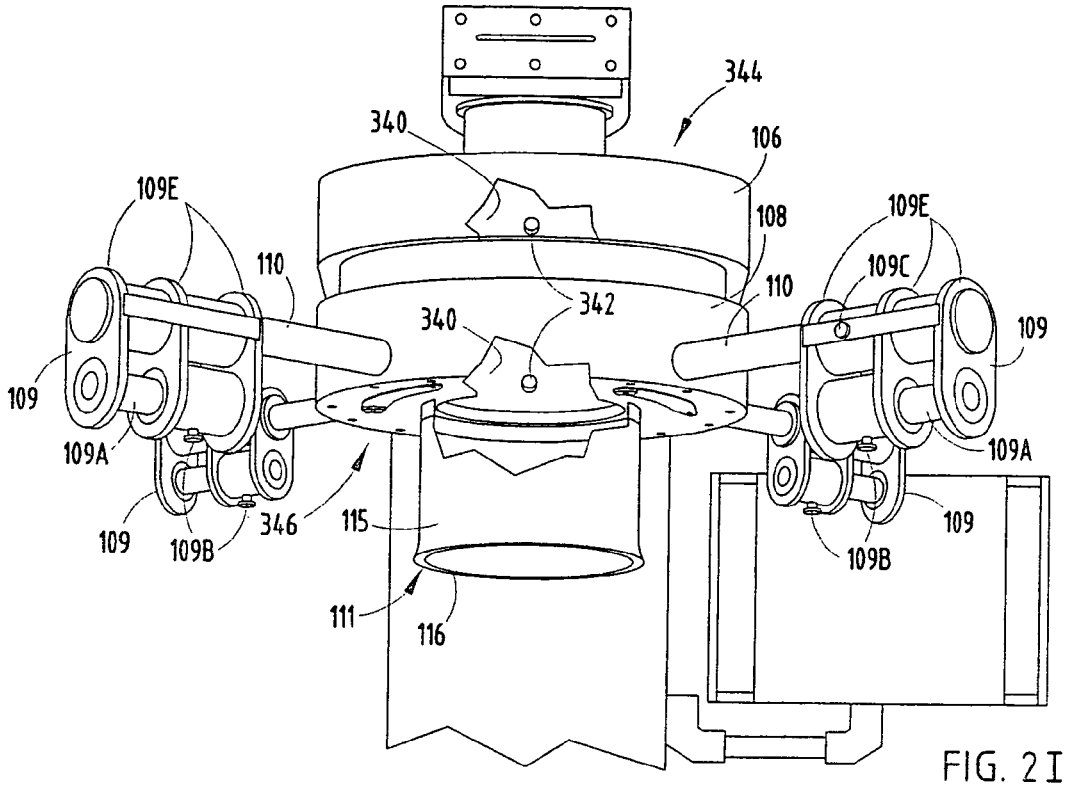
FIG. 2I is a front perspective view of a rotary carriage and fill carriage incorporating a clean-in-place system.

As shown in FIG. 2I, a clean-in-place system may be utilized inside of the fill carriage 106 and inside of the rotary carriage 108, typically between outer pipe 115 and the outer wall 360 of the rotary carriage. The clean-in-place system is used to manually or automatically clean interior areas 340 of the bulk bag filling system 100 of material. One, two, or more jet nozzles 342 may be disposed on interior portions in either or both of the fill carriage 106 and/or the rotary carriage 108. If pairs of jet nozzles are used, they are typically positioned on opposing interior portions of the fill carriage on the rotary carriage. However, it is contemplated that one or several jet nozzles could be disposed inside the fill carriage 106 and the rotary carriage 108. Typically, compressed air is forced out of the jet nozzles 342 in a spiraling, tornado-like manner to blow any residual dust or other material out of the system 100. The fill carriage clean-in-place system 344 can be used when the bag 10 is in place thereby blowing residual material into the bag 10 helping prevent waste. Alternatively, the fill carriage clean-in-place system 344 may be used to blow out residual material when the bag 10 is not in place. The rotary carriage clean-in-place system 346 is used primarily for maintenance and cleaning of the rotary carriage 108, which is not otherwise easily accomplished. These systems 344, 346 can be actuated manually by an operator, or can be programmed to run automatically using the electrical subsystem 200 of the bulk bag filling system.

Figure 2J:
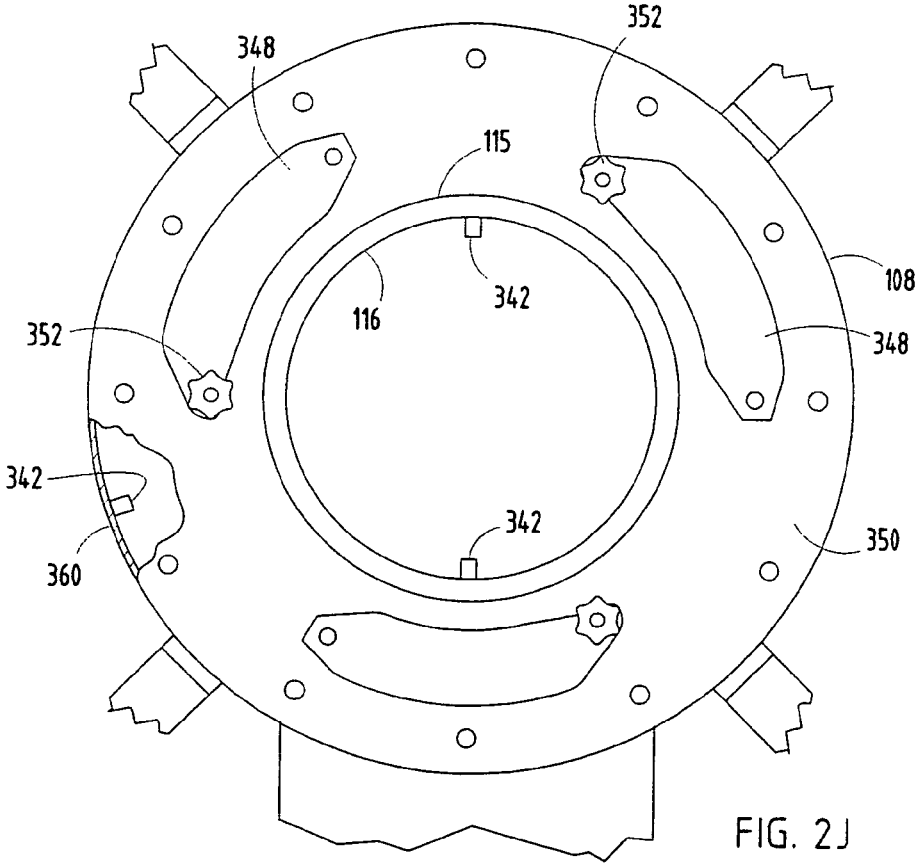
FIG. 2J is a bottom plan view of the rotary carriage of FIG. 2G.

Referring to FIG. 2J, one or more doors 348, typically three doors, are provided on a bottom portion 350 of the rotary carriage 108 to allow residual material to escape from the rotary carriage 108 after the jet nozzles 342 have been activated. The doors 348 are typically actuated between an opened and closed position by the operator. When the doors are open, the resulting aperture allows residual material to escape. Additionally, the doors 348 can be closed and locked down by hand tightened fasteners 352. Typically, the doors swing open and closed in the same general plane as the door and essentially just slide out of the closed position covering the apertures.

Figure 3A:
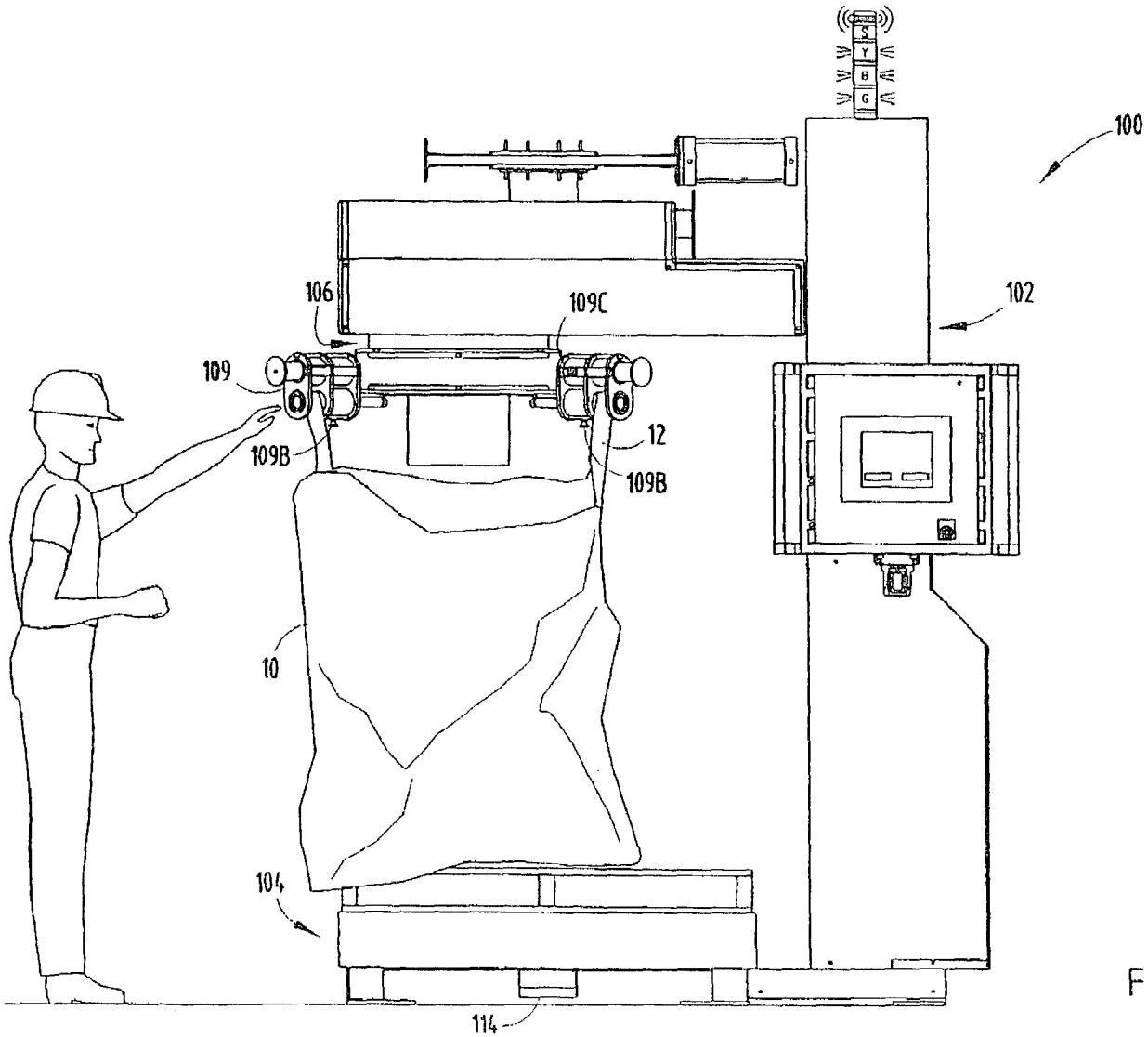
FIG. 3A is a side view of a bulk bag filling system of FIG. 2A, with the fill carriage positioned in a bag loading position.

With reference to FIG. 3A, the bulk bag filling system 100 is shown, with the fill carriage 106 (and the rotary carriage 108) lowered and extended toward the operator to allow the operator to efficiently mount the bag 10 to the bag loop hangers 109 of the rotary carriage 108. The fill carriage 106 may implement, for example, cam rollers in conjunction with a truck and carriage to achieve horizontal motion.

Figure 3B:
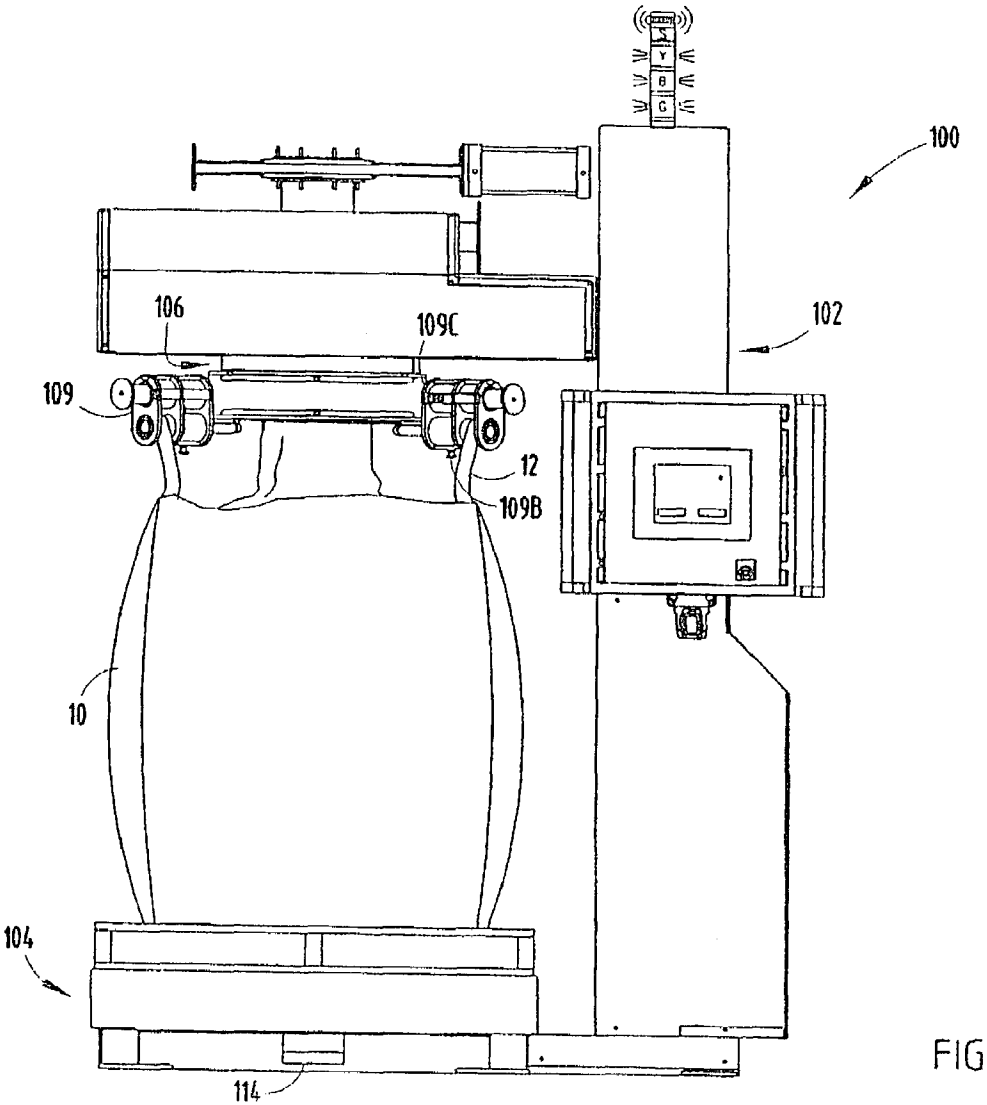
FIG. 3B is a side view of a bulk bag filling system of FIG. 2A, including a fill bag, and positioned in a bag filling position to fill the bag with bulk materials.
Figure 3C:
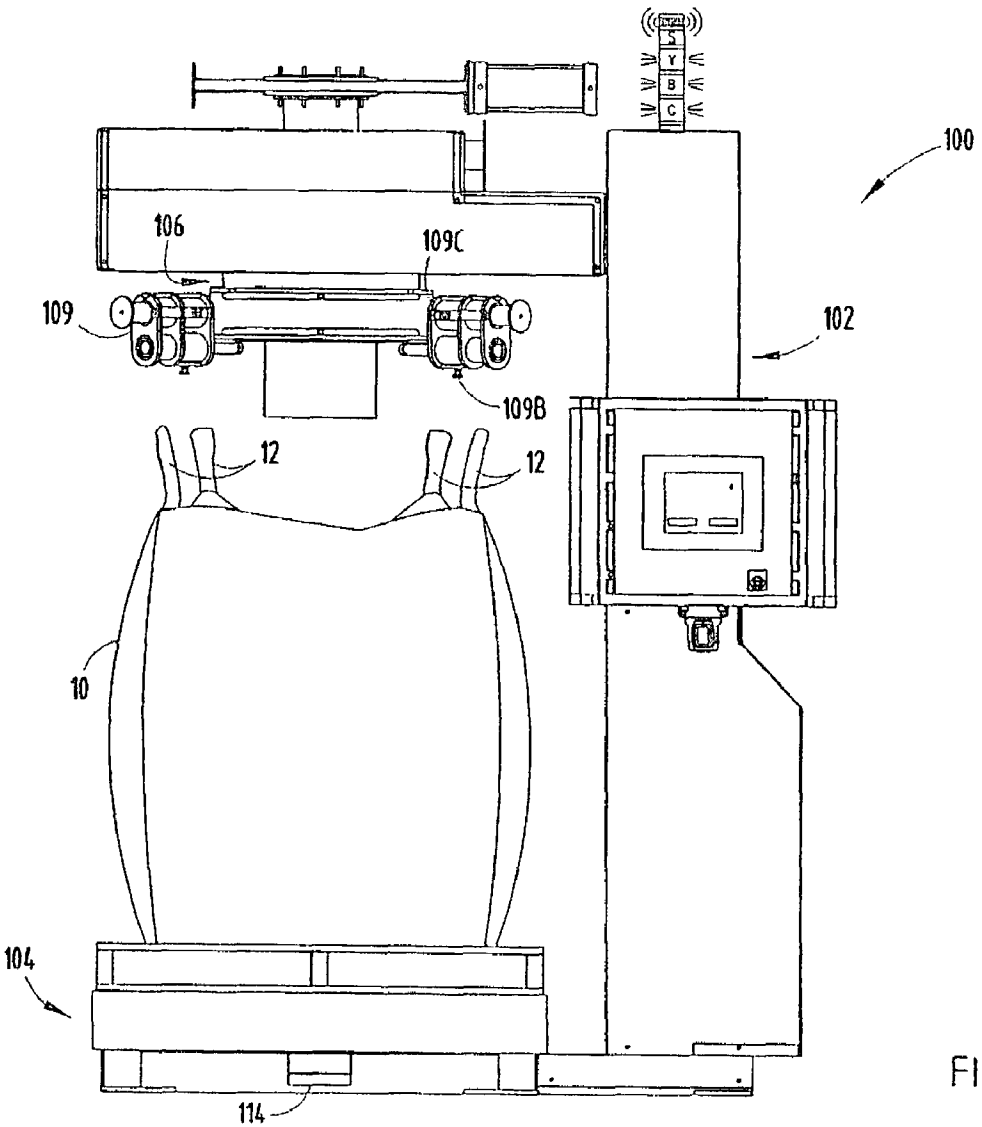
FIG. 3C is a side view of a bulk bag filling system of FIG. 2A, with the height adjustment actuator adjusted to position the fill carriage in a bag unloading position.

As briefly mentioned above, in each of the above embodiments the rotary carriage 108 can include an actuator for rotating the rotary carriage 108 or the rotary carriage 108 can be operated manually by the operator. Upon connecting the bag 10 to the bag loop hangers 109 of the rotary carriage 108, the seal 113 of the spout seal inflation subsystem is inflated and the fill carriage 106 is then raised and retracted to the fill position, as is shown in FIG. 3B. Upon reaching the fill position, the bag 10 is inflated and the inlet valve automatically actuates, as required for accurate weighing. The densification system turns on and off at a programmed interval, based on, for example weight, during the fill process to ensure a safe stackable bag. As is depicted in FIG. 3C, when the fill cycle is complete, the bag loops (straps) 12 of the bag 10 are released by retraction of bag loop capture pins 109A as discussed above, at which point the fill carriage 106 is raised to allow the fill bag 10 to be removed from the base 104. The structure for raising and lowering the fill carriage 106 may implement, for example, a wide variety of actuators in conjunction with cam rollers. As noted above, the bag attachment height may be manually or automatically changed. For example, height adjustment of the fill carriage 106 may be achieved by one or more hydraulic rams, pneumatic cylinders, a manual positioning device (e.g., a pin and post configuration), a manual crank or an electro-mechanical device (e.g., a motor with associated drive gears).

Accordingly, bulk bag filling systems described herein advantageously position a fill carriage (including a rotary head) to allow an operator to attach a bag to the system for filling. The systems may also advantageously include a bag inflation subsystem that ensures the bag is properly filled for improved handling and storage. In systems that implement a dust-tight spout subsystem, a positive seal may be provided for safe, dust-free filling of submicron powders. As previously discussed, a densification system, when implemented, provides a stable compact stackable bag and an integrated weight scale allows for accurate repeatable filling, among other functions. Also, a system that implements a horizontal displacement device with minimal moving parts and a substantial displacement distance is beneficial.

Figure 4A:
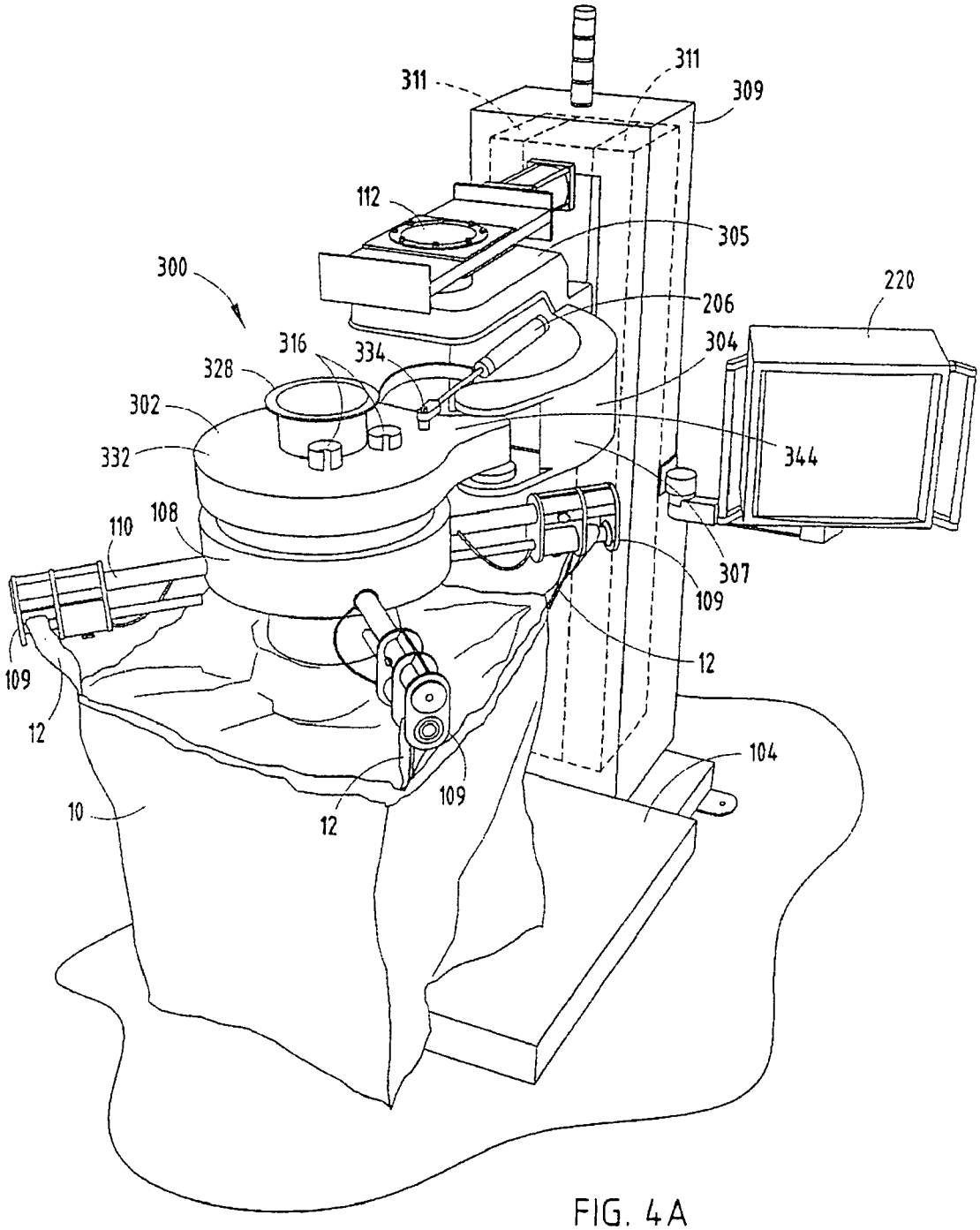
FIG. 4A is a top perspective view of a bulk bag filling system with a horizontal displacement device.
Figure 4B:
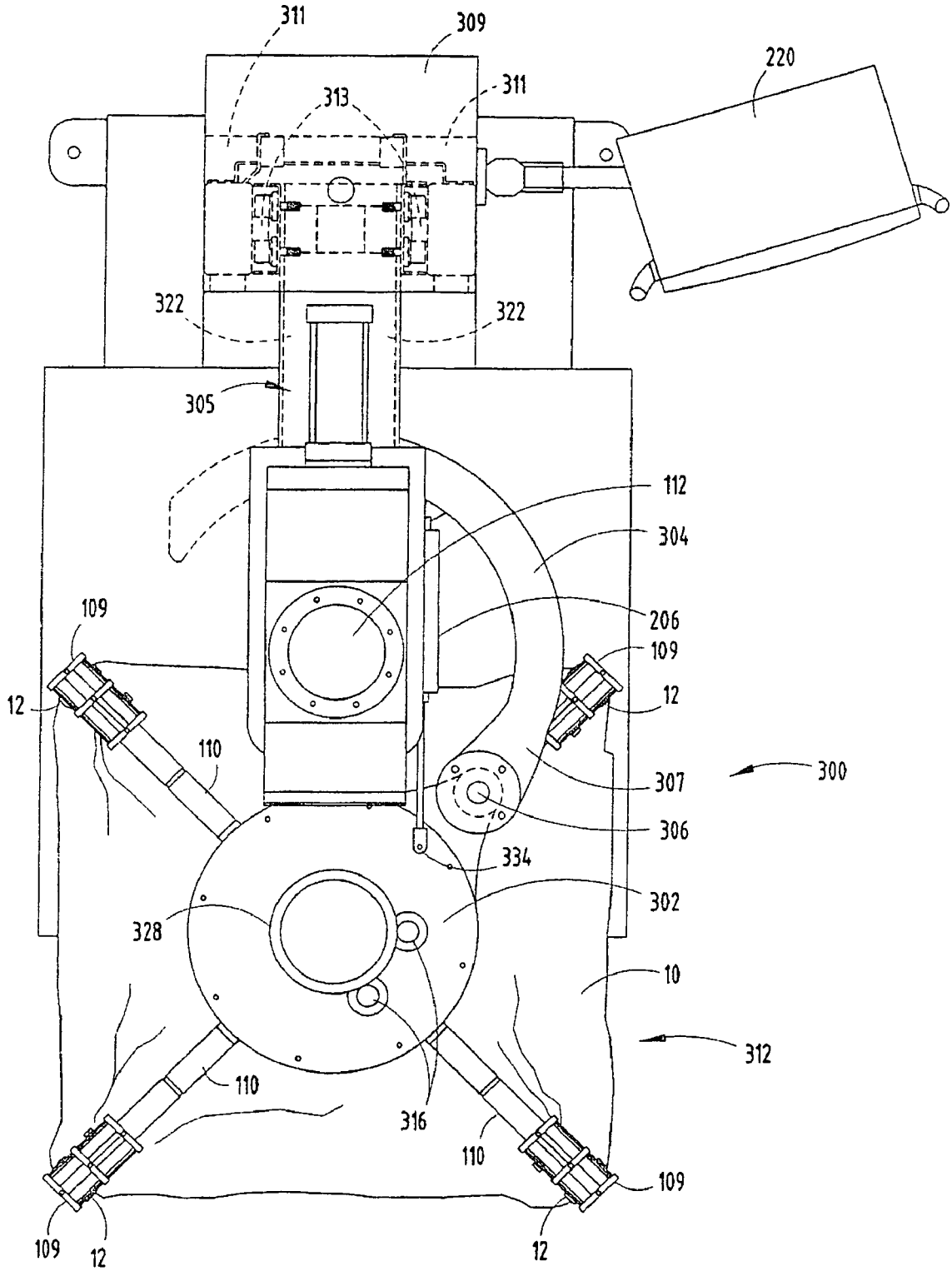
FIG. 4B is a top plan view of the bulk bag filling system of FIG. 4A, with the horizontal displacement device pivoted outward from the frame.
Figure 4C:
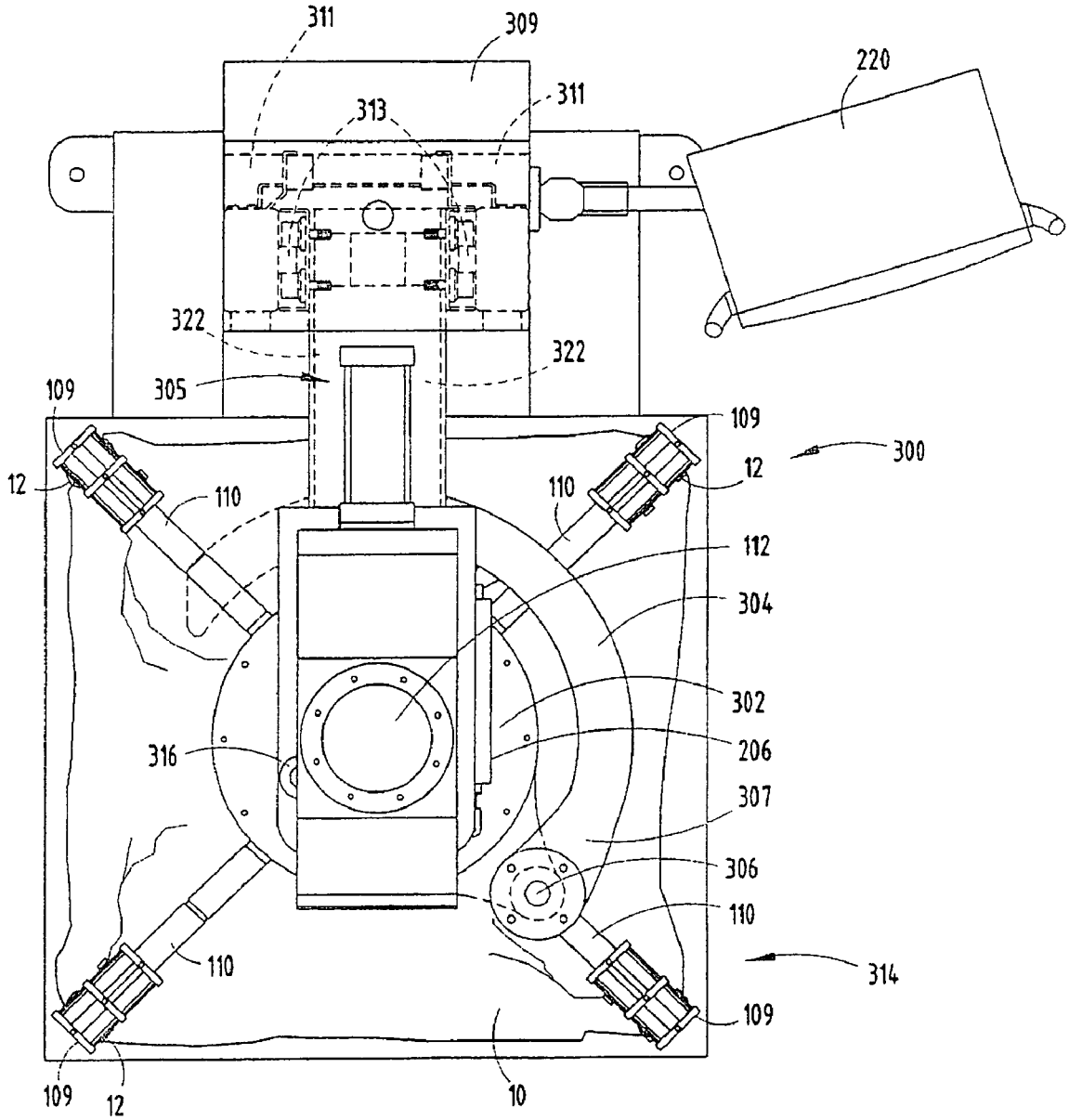
FIG. 4C is a top plan view of the bulk bag filling system of FIG. 4A, with the horizontal displacement device pivoted inward toward the frame in a bag filling position.

As shown in FIGS. 4A-4C, another embodiment of the bulk bag filling system 300 of the present invention includes an upwardly extending support member 309 engaged to a base 104. A fill carriage assembly engagement member 305 engages the upwardly extending support member 309 as well as the fill carriage 302. The upwardly extending support member 309 typically includes two upwardly extending mounts 311 that contain tracks 313 (FIG. 4B), which engage a collar portion 322 of the fill carriage assembly engagement member 305. The tracks allow the entire assembly to be motivated or otherwise moved vertically up and down to an operator desired height. The fill carriage assembly engagement member 305 further includes a fill carriage assembly engagement portion 304, that itself has a distal end portion 307. The fill carriage assembly engaging portion 304 typically is a single substantially C-shaped member (see FIGS. 4A-4C) (typically the support member does not extend beyond the fill carriage assembly engagement member, but in some cases, could extend beyond the collar portion of the fill carriage assembly engagement member as shown in phantom in FIGS. 4B and 4C). The fill carriage assembly engaging portion 304 may be a single substantially L-shaped member or any other support member(s) that will support the fill carriage 302. Typically, the fill carriage assembly engaging portion 304 allows the fill carriage 106 to pivot about a pivot point located horizontally away from the upwardly extending support member and be slightly offset such that the fill carriage 302 can be pivotally moved from a bag filling position, where the fill carriage is aligned with the fill port 112 to allow material to pass through the fill port and fill carriage into the bag, to a bag attachment position (see FIGS. 4A-4B). Essentially, the fill carriage assembly may take any shape that provides load support to the fill carriage 302 while allowing it to pivot.

Regardless of the shape of the fill carriage assembly engaging portion, the fill carriage 302 typically engages a distal end portion 307 (the end not engaged to the fill carriage assembly engagement member 305) by a pivot pin 306. Typically, the fill carriage has a substantially circular metal frame element 332, which engages the pivot pin 306 and distal end portion 307 at a slightly bulbous portion 344 of the substantially circular frame element 322. The pivot pin 306 is oriented in the vertical direction, thus allowing rotation of the fill carriage 302 about the pivot pin 306 in a horizontal plane. Typically, the pivot pin includes a pair of bearings and a shaft.

The rotation of the fill carriage 302 to a bag filling position at least substantially, more typically directly, aligns the upper portion 328 of the spout 111, which traverses through the center of the fill carriage to thereby enable material flow into a bulk bag vertically with a fill port 112 at least sufficiently such that material can pass through the bag. The fill carriage 302 may be rotated manually by an operator, or the fill carriage 302 may be adjusted by a fill carriage actuator 206. The fill carriage actuator is typically a pneumatic cylinder or other force applying cylinder or device, which is capable of applying force to the fill carriage assembly to move it from a bag filling position to a bag attachment position. Typically, the cylinder is mounted at one end to the fill carriage assembly engaging position and at the end (the piston rod end) to the fill carriage 302 as shown in FIGS. 4A-4B. Typically, less force than two track systems is required to move the fill carriage about the pivot pin 306. When rotating the fill carriage, the fill carriage actuator 206 typically rotates about 5 degrees to about 10 degrees at the end not engaged to the fill carriage and about 90 degrees at the end engaged to the fill carriage 302. The fill carriage also typically has a bag inflator actuator 218 as explained in greater detail above, which moves air into the bag to minimize wrinkles and to provide maximum volume when the bag is filled with material. The fill carriage 302, as discussed above, typically contains a rotary carriage 108 that is rotatable thereby allowing a user to easily attach the bag loops 12 without the user having to walk around the bulk bag filling system 300. The loops 12 can be engaged to the loop bag hanger 109 from the front of the system 300. The fill carriage actuator 206 of this embodiment typically interacts with a processor similarly to the fill carriage actuator 206 as disclosed above.

As illustrated in FIGS. 4B and 4C, the fill carriage 302 can be rotated at least about 90 degrees between the bag loading position 312 (FIG. 4B) and the bag filling position 314 (FIG. 4C). An operator can load the bag 10 onto bag loop hangers 109 in the bag loading position 312. Then, the bag 10 can be rotated into the bag filling position 314 so that the fill carriage 302 is in at least substantial alignment, typically direct alignment, with and below the fill port 112 so that material can be poured into the bulk bag 10. The 90 degree rotation allows the fill carriage 302 and rotary carriage 108 to move approximately two feet between the bag loading position 312 and the bag filling position 314, roughly double the distance of two track systems. This enables an operator to work at a comfortable distance from the frame 309 of the bag filling system 300.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

What is claimed is:

1. A bulk bag filling system, comprising:

a base;

a support member upwardly extending from the base;

a fill carriage assembly engagement member comprising a fill carriage assembly engagement portion, wherein the fill carriage assembly engagement member engages the support member;

a fill carriage assembly having a top and a bottom and comprising a spout that extends through the fill carriage assembly from the top to the bottom of the fill carriage assembly, wherein the fill carriage is adapted to be at least substantially aligned with a fill port when the fill carriage is in a bag filling position and the fill carriage assembly engages the fill carriage assembly engagement member at a distal end portion of the fill carriage assembly engagement portion using a pivot pin assembly such that the fill carriage is adapted to traverse in a curvilinear path; and a rotary carriage comprising a substantially circular center section rotatably engaged to the fill carriage assembly wherein the rotary carriage further comprises at least four outwardly, radially extending members that each engage a bag loop hanger comprising a bag loop capture pin.

2. The bulk bag filling system of claim 1, wherein the fill carriage assembly further comprises a substantially circular frame having a bulbous portion that engages the pivot pin assembly.

3. The bulk bag filling system of claim 2, wherein the fill carriage assembly is rotatable about the pivot pin assembly at least about 90 degrees and wherein the system further comprises an upper member that comprises the fill port and wherein the upper member is engaged to the support member upwardly extending from the base.

4. The bulk bag filling system of claim 3, wherein the fill carriage assembly is adapted to traverse horizontally between the bag filling position and a bag attaching position and the horizontal distance between the bag filling position and the bag attaching position is about 24 inches.

5. The bulk bag filling system of claim 2, further comprising:

an input/output device operatively connected to the bulk bag filling system, wherein the input/output device is configured to receive input from an operator and provide output to the operator and wherein the fill carriage assembly is actuated between the bag filling position and a bag attaching position using a fill carriage assembly actuator that is engaged to the fill carriage assembly and the fill carriage assembly engagement member;

a processor coupled to the input/output device and the fill carriage actuator; and a memory subsystem coupled to the processor, the memory subsystem storing code responsive to input from an operator that instructs the processor to perform the steps of:

controlling the fill carriage assembly actuator to position the fill carriage assembly into the bag filling position; and controlling the fill carriage assembly actuator to position the fill carriage assembly into a bag attaching position.

6. The bulk bag filling system of claim 1, wherein the fill carriage assembly engagement member further comprises a collar portion and the support member upwardly extending from the base further comprises a vertical movement track system that engages the collar portion of the fill carriage assembly engagement member and is adapted to traverse the fill carriage assembly vertically.

7. The bulk bag filling system of claim 1, wherein the spout of the fill carriage assembly comprises a center pipe having a diameter and an outer pipe having a diameter greater than the diameter of the center pipe, an outer surface, and spaced about the center pipe such that a gap exists between the center pipe and the outer pipe and wherein the outer surface of the outer pipe contains a spout seal inflation system adapted to seal a neck of a bulk bag.

8. The bulk bag filling system of claim 7, further comprising a pneumatic actuator engaged to the fill carriage assembly and the fill carriage assembly engagement member for actuating the fill carriage assembly between the bag filling position and a bag attaching position.

9. The bulk bag filling system of claim 8, wherein the fill carriage assembly engagement member comprises a fill carriage assembly engagement member chosen from the group consisting of a C-shaped fill carriage assembly engagement member; an L-shaped fill carriage assembly engagement member; and a bowed fill carriage assembly engagement member.

10. The bulk bag filling system of claim 1, wherein the rotary carriage comprises four outwardly, radially extending members spaced at equal intervals from one another in a plane defined by the four outwardly, radially extending members and wherein the bag loop capture pins are substantially parallel to the outwardly, radially extending members, are capable of receiving bag loops of a bulk bag, and have a circular cross-section.

11. A displacement system for a bulk bag filling system comprising:

a base;

a frame member that extends upward from the base;

a horizontal displacement member comprising a first end engaged to the frame member and a distal end portion; and a fill carriage having a top surface and a bottom surface and a substantially circular frame and wherein the fill carriage is pivotally engaged to the distal end portion such that the fill carriage is capable of moving between a bag filling position and a bag loading position and the fill carriage traverses a curvilinear path when rotated between the bag filling position and the bag loading position and wherein the fill carriage is operably connected to a plurality of bulk bag loop hanger assemblies each of which are adapted to retain a bag loop of a bulk bag and wherein the fill carriage comprises a spout that extends through the fill carriage from the top surface of the fill carriage to the bottom surface of the fill carriage.

12. The bulk bag filling system of claim 11, wherein the fill carriage is pivotally engaged to the horizontal displacement member by a pivot pin assembly and the bag loop hanger assemblies comprise a bag loop receiving space defined by two support members and a capture pin capable of being positioned in at least three positions.

13. The bulk bag tilling system of claim 12, wherein the pivot pin assembly comprises a shaft and a pair of bearings and wherein the fill carriage is rotatable about the pivot pin at least about 90 degrees.

14. The bulk bag filling system of claim 12, wherein the bag loop capture pin of each bag loop hanger assembly has a substantial circular cross-section and is adapted to be positionable in a fully retracted position, a partially retracted position, and an engaged position fully traversing the bag loop receiving space.

15. The bulk bag filling system of claim 13, wherein:

the horizontal distance between the center of the fill carriage when the fill carriage is in the bag filling position and the center of the fill carriage in the bag loading position is about 24 inches.

16. The bulk bag filling system of claim 15, further comprising:

a pneumatic actuator operably connected to the fill carriage and the horizontal displacement member and wherein the pneumatic actuator is adapted to move the fill carriage between the bag loading position and the bag filling position.

17. The bulk bag filling system of claim 15, wherein the horizontal displacement member comprises a collar portion engaged to the frame member and a second portion having the distal end portion wherein the second portion comprises a second portion chosen from the group consisting of a substantially C-shaped second portion and a substantially L-shaped second portion.

18. The bulk bag filling system of claim 11, wherein the fill carriage further comprises an external surface and wherein the system further comprises a rotary carriage comprising a center portion spaced circumferentially about at least a portion of the external surface of the fill carriage and wherein the rotary carriage is rotatable about the external surface of the fill carriage and wherein the rotary carriage further comprises at least four outwardly, radially extending support members and wherein a bag loop hanger assembly operably engages each outwardly, radially extending support member and comprises a bag loop capture pin spaced below each outwardly, radially extending support member.

19. A method of filling a bulk bag comprising the steps of:

providing the bulk bag filling system of claim 1 and a bulk bag having a plurality of bulk bag loops and a neck;

rotating the fill carriage outwardly about a pivot axis existing at the pivot pin assembly;

capturing at least one bag loop of the bulk bag with one of the bag loop capture pins;

rotating the rotary carriage;

capturing at least one additional bag loop of the bulk bag with one additional bag loop capture pin;

engaging the neck of the bulk bag with the spout of the fill carriage assembly;

optionally, vertically elevating the bulk bag with the bag loop hangers;

rotating the fill carriage into a bag filling position below the fill port;

filling the bulk bag with a material wherein filling the bulk bag with a material comprises the step of allowing the material to pass through the fill port and the fill carriage into the bulk bag; and releasing the bag loops of the bulk bag from the bag loop hangers.

20. The method of claim 19, the method further comprising the step of sealing the neck of the bulk bag using a bag spout sealing actuator and wherein the step of capturing at least one bag loop of the bulk bag with one of the bag loop capture pins comprises capturing two bulk bag loops and the step of capturing at least one additional bag loop of the bulk bag with one additional bag loop capture pin comprises capturing two bulk bag loops.

21. A displacement system for a bulk bag filling system comprising:

a base;

a. frame member that extends upward from the base;

fill carriage assembly engagement member comprising a fill carriage assembly engagement portion having a distal end portion distal from the frame member;

a fill carriage having a top surface and a bottom surface pivotally engaged to the distal end portion such that the till carriage is capable of moving between a bag filling position and a bag loading position and the fill carriage traverses a curvilinear path when rotated between the bag filling position and the bag loading position and wherein the fill carriage is operably connected to a plurality of bulk bag loop hanger assemblies each of which are adapted to retain a bag loop of a bulk bag and wherein the fill carriage comprises a spout that extends through the fill carriage from the top surface of the fill carriage to the bottom surface of the fill carriage; end wherein the fill carriage of the bulk bag filling system receives a single bulk bag.

22. A displacement system for a bulk bag filling system comprising:

a base;

a frame member that extends upward from the base;

a fill carriage assembly engagement member comprising a fill carriage assembly engagement portion having a distal end portion distal from the frame member;

a fill carriage having an external surface wherein the fill carriage is pivotally engaged to the distal end portion such that the fill carriage is capable of moving between a bag filling position end a bag loading position and the fill carriage traverses a curvilinear path when rotated between the bag filling position and the bag loading position and wherein the fill carriage is operably connected to a plurality of bulk bag loop banger assemblies each of which are adapted to retain a bag loop of a bulk bag and wherein the fill carriage comprises a spout that extends through the fill carriage;and a rotary carriage comprising a center portion spaced about at least a portion of the external surface of the fill carriage and wherein the rotary carriage is rotatable about at least a portion of the external surface of the fill carriage engaged to the fill carriage assembly.

* * * * *

UNITED STATES PATENT AND TRADEMARK OFFICE

CERTIFICATE OF CORRECTION

PATENT NO. : 7,267,145 B2
APPLICATION NO. : 11/415779
DATED : September 11, 2007
INVENTOR(S) : Scott L. Nyhof et al.

It is certified that error appears in the above-identified patent and that said Letters Patent is hereby corrected as shown below:

Column 11
Claim 13, line 58, “tilling” should be --filling--.

Column 13
Claim 21, line 10, “till” should be --fill--.

Column 14
Claim 22, line 13, “banger” should be --hanger--.

Signed and Sealed this

Seventh Day of April, 2009

JOHN DOLL
*Acting Director of the United States Patent and Trademark Office*